United States Patent [19]

Reichlin

[11] 3,965,651

[45] June 29, 1976

[54] DEVICE FOR THE MANUFACTURE AND FILLING OF PACKAGES

[76] Inventor: Erwin Reichlin, Waldegg, Walchwil, Switzerland

[22] Filed: Dec. 10, 1974

[21] Appl. No.: 531,214

[30] Foreign Application Priority Data

Dec. 14, 1973 Switzerland ..... 17592/73

[52] U.S. Cl. ..... 53/183; 53/29

[51] Int. Cl.[2] ..... B65B 1/02; B65B 9/04

[58] Field of Search ..... 53/28, 29, 30 R, 141, 53/178, 182, 183, 184 R, 185, 112 A; 156/200, 201, 462, 464, 470

[56] References Cited

UNITED STATES PATENTS

| | | | |
|---|---|---|---|
| 2,384,492 | 9/1945 | Rebechini | 53/185 X |
| 2,793,676 | 5/1957 | Hubmeier | 156/462 |
| 3,020,687 | 2/1962 | Joa | 53/28 X |
| 3,178,494 | 4/1965 | Tisdale | 156/462 X |
| 3,314,110 | 4/1967 | Missbach | 425/384 X |
| 3,645,066 | 2/1972 | Drygulski | 53/112 A |
| 3,808,772 | 5/1974 | Turtschan | 53/184 X |

*Primary Examiner*—Robert L. Spruill
*Attorney, Agent, or Firm*—Roylance, Abrams, Berdo & Kaul

[57] ABSTRACT

A method of forming packages in which a first thermoformable strip is provided with a plurality of parallel longitudinal grooves or depressions, the grooves are filled with a material to be packaged, and the grooves are then covered by a sealing a second, flat strip to the regions of the first strip between the grooves and along the edge margins thereof. The grooves are formed sequentially from the center of the first strip outwardly toward the side edges in pairs. The filled and covered continuous article is then transversely sealed and severed into individual packages. A machine for performing this method includes a forming plate having a longitudinal parallel grooved surface, means for moving the strip along the surface, and a plurality of forming rolls, each roll having pairs of annular ridges which press the strip into the grooves on the plate to form the depression. The first one of the rolls has a pair of such ridges near and straddling the centerline of the strip, the second has an additional pair spaced outwardly farther from the centerline, the third has another pair, and so forth, so that the depressions are formed sequentially from the center of the strip outwardly. The forming plate can be heated and adjustable to vary the spacing thereof from the rolls. A cooling plate is provided downstream of the forming plate, along with filling, sealing and severing means, and means for driving the rolls.

5 Claims, 3 Drawing Figures

DEVICE FOR THE MANUFACTURE AND FILLING OF PACKAGES

This invention relates to a process for the manufacture and filling of packaging from two strips, one of which is shaped to form hollow spaces with the hollow spaces being filled or dosed with the contents, the strips being partly joined and closed and the strips thus joined together being cut into parts with at least one compartment portion, and also to an apparatus for carrying out the process.

Multiple packaging, i.e., packaging which has several closed hollow spaces for filling with different contents, for example, salt in the one and pepper in the other hollow space, is known. The capacity of such a packaging plant is limited. An object of the invention is to perfect a process of the kind described in the introduction in such a way that a considerable increase in the capacity is achievable in a continuous process.

According to the invention this object is achieved by shaping a first strip beginning from the middle of the strip outwards in steps, each forming step forming a new hollow space running in the direction of movement of the strip.

To carry out the process in accordance with the invention there is disclosed a machine characterized by a forming station with a forming plate which is provided with longitudinal grooving in the direction of movement of a first strip and above which there are arranged a number of forming rolls longitudinally spaced apart from each other and provided with transversely spaced annular ridges engaging and mating with the longitudinal grooving as a result of which, as viewed in the direction of movement of the one strip, the ridges on the first forming roll dip into and press the strip into grooves arranged one on each side of the longitudinal centerline of the first strip and the following forming rolls dip and press the strip into further grooves disposed on both sides and spaced further from the centerline until the desired number of grooves in the form plate are engaged by the corresponding number of forming roll ridges.

In order that the manner in which the foregoing and other objects are attained in accordance with the invention can be understood in detail, a particularly advantageous embodiment thereof will be described with reference to the accompanying drawings, which form a part of this specification and wherein.

Figure 2:
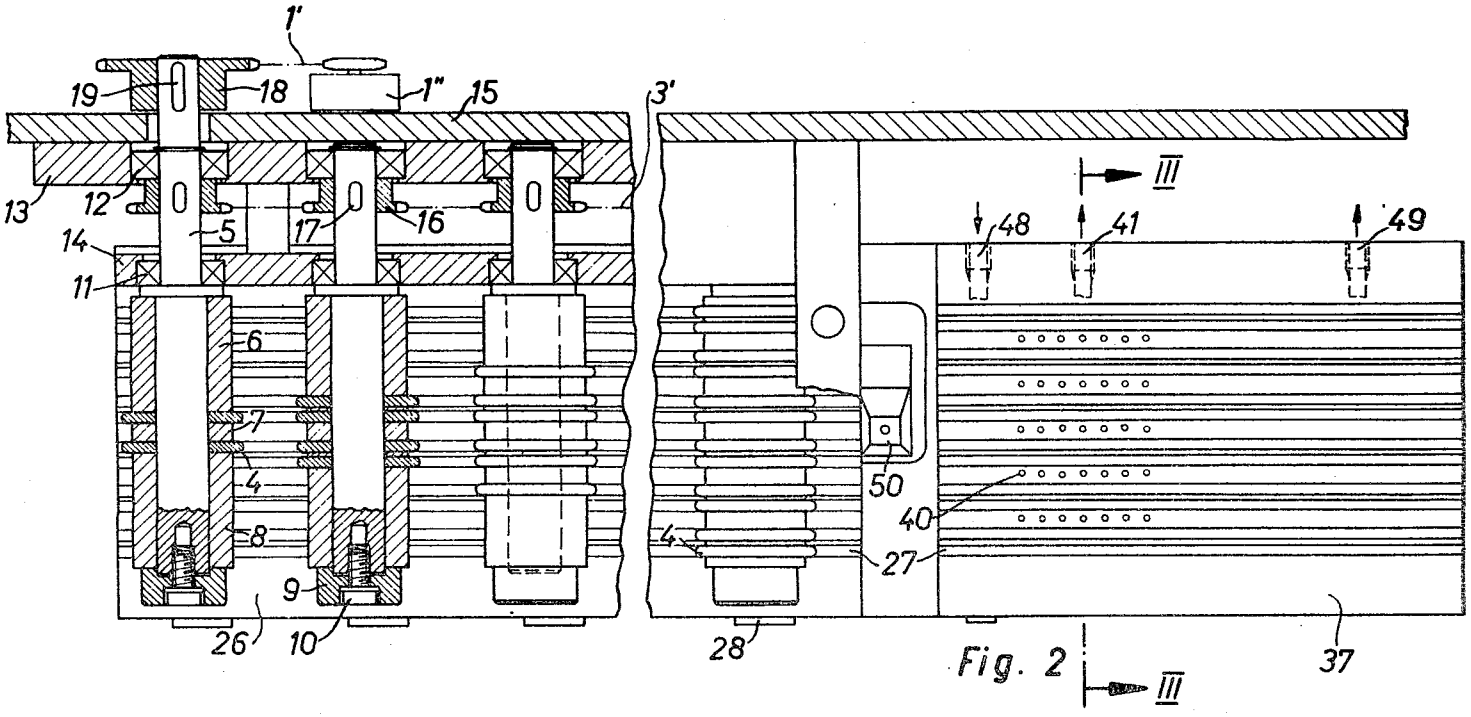
FIG. 2 is a sectional view along the line II — II of FIG. 1.

On the front face of a machine casing 1 a forming station indicated generally at 2 is suitably arranged. The forming station 2 has a plurality of forming rolls indicated generally at 3, each roll being provided with two or more peripheral annular ridges 4. Forming rolls 3 are longitudinally spaced apart, i.e., in the direction of motion of the strip to be formed, and are rotatable about axes extending transversely with respect to the strip. As can be seen in FIG. 2, the first one of forming rolls 3 has two peripheral annular ridges 4, one on each side of the centerline of the path of travel of the strip to be formed. The next forming roll is provided with annular ridges which are longitudinally aligned with the ridges on the first forming roll and is further provided with two annular ridges which are similarly spaced on either side of the centerline, but are farther from the centerline. The third forming roll has ridges which are aligned with those on the second, and has an additional pair of ridges further outwardly transversely spaced, each successive roll being provided with additional ridges until the last forming roll, as illustrated in FIG. 2, is provided with six pairs of annular ridges, six such ridges being provided on each side of the centerline. As can be understood from this, each subsequent roll has two additional ridges, resulting in a total of 12 peripheral ridges and a total of six forming rolls in the embodiment shown.

The positioning and mounting of the forming rolls is best seen in FIG. 2 wherein a shaft 5 carries the discs which form the peripheral annular ridges 4 as well as the roll bodies 6, 7 and 8, forming each roll 3. The discs 4 and roll portions 6–8 are held together by a securing plate 9 which is retained on shaft 5 by a screw 10. Shaft 5 is journaled for rotation by anti-friction bearings 11 and 12 in rails 14 and 13, respectively, which are fixed to wall 15 of the machine casing 1. A sprocket wheel 16 is fixed by a key 17 to each shaft 5. The shaft 5 on which the first one of rolls 3 is mounted passes through wall 15 and is provided, on the opposite side of wall 15, with a sprocket wheel 18 which is fixedly attached to the shaft extension by a key 19. Sprocket 18 is driven by a chain 1' and drive means 1'', located within machine casing 1, and shown in FIG. 2, so that the sprocket 18 and its associated forming roll can be rotated. An additional drive chain 3' encircles all of sprocket wheels 16 of the forming rolls so that driving sprocket 18 and its associated shaft 5 causes synchronous rotation of all of shaft 5 and their associated forming rolls 3. The forming rolls thus rotate at the same speed.

Figure 1:
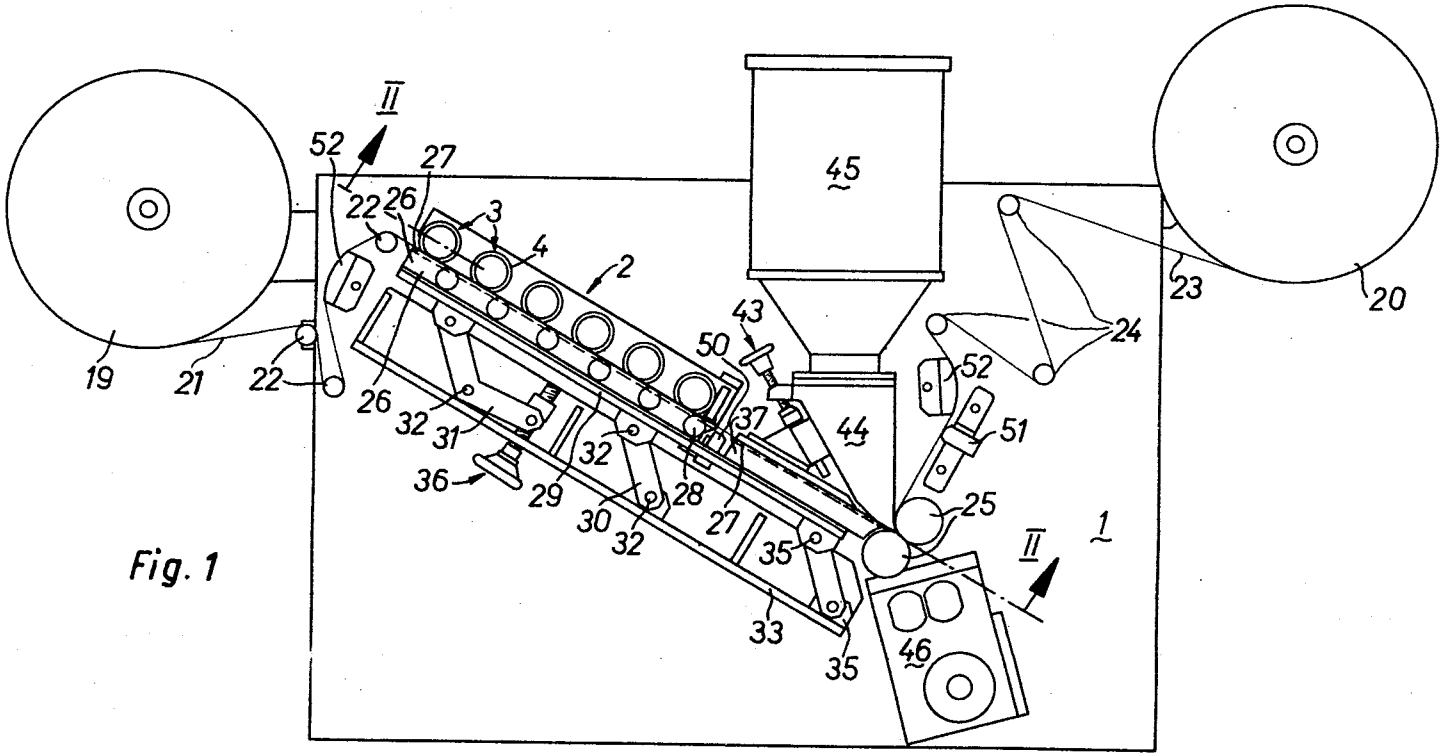
FIG. 1 is a front elevation of a machine for forming, manufacturing and filling packaging from two strips.

As seen in FIG. 1, rotatable strip supply rolls 19 and 20 are mounted for rotation on opposite ends of the machine casing so that a strip 21 of material to be formed can be withdrawn from supply roll 19, passed around guide rolls 22 and through the assembly including forming rolls 3, a second strip 23 being withdrawn from supply roll 20 and around similar guide rollers 24, the two strips coming together between sealing rolls 25.

Beneath the forming rolls there is arranged a forming plate 26 which is provided with a plurality of longitudinal semi-circular grooves 27 into which the annular ridges 4 of the forming rolls extend. Heating elements 28 are incorporated in the forming plate 26 for heating the forming plate. Forming plate 26 is supported on a plate 29 which is part of a movable parallelogram construction including plate 29 and control arms 30 and 31. Arms 30 and 31 are pivotally connected to plate 29 and are also pivotally connected to a plate 33 by gusset plates such as indicated at 35. Arm 31 is formed as a bell crank and is provided with a stroke adjuster 36 which, for example, can be a worm gear or threaded adjuster. By rotating the stroke adjuster 36 plate 29 is made to move, parallel to itself, relative to forming rolls 3, adjusting the spacing between the rolls and the forming grooves. Plate 33 can be constructed as an angle section which is fixed immovably to wall 15 of the machine casing.

A cooling and braking plate 37 which has grooves constituting extensions of grooves 27 in forming plate 26 is also arranged on plate 29. As can be seen from FIG. 3, a strip guide plate 38 with longitudinal ribs 39 extends parallel to plate 37 with the ribs mating with grooves 27 in the cooling and braking plate.

Between grooves 27 of the cooling and braking plate 37 there are openings 40 which are connected by a manifold 41 to a vacuum system. The strip guide plate 38 is adjusted movably by means of a support and can, by means of a worm drive 43, be adjusted relative to the cooling and breaking plate 37.

A dosing or filling device 44 and a filling hopper 45 for feeding the dosing device 44 is arranged on machine casing 1 near the downstream end of the forming, cooling and braking assembly.

In the forming station 2 the strip delivered from roll 19 is shaped so that it has longitudinal grooves corresponding to the profile of the grooves in forming plate 26. Strip 21 passes between the cooling and braking plate 37 and the strip guide plate 38 and meets strip 23 from roll 20 at the mouth of the dosing device 44. Here the filling takes place in such a way that the contents are delivered into the grooves formed in strip 21. Strips 21 and 23 are then joined in the areas of the strips between the formed grooves, the joining taking place between two sealing rollers 25 so that longitudinal hollow spaces result which, by appropriately shaped sealing rollers, are pressed together and joined longitudinally so that the contents are housed in elongated sealed hollow spaces. Finally, the packaging assembly formed from strips 21 and 23 is sealed transversely and cut in a cutting device 46 and separated into portions having two or more hollow spaces.

Figure 3:
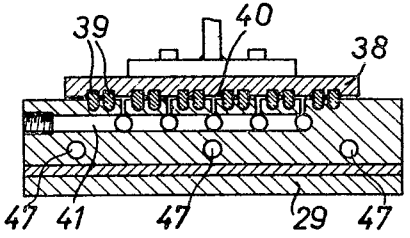
FIG. 3 is a sectional view along the line III — III of FIG. 2.

The strip 21, which was heated during forming in forming station 2, is cooled as it passes through the cooling and breaking plate 37 connected to it. As can be seen in FIG. 3, cooling ducts 47 are arranged in the interior of the cooling and breaking plate, which ducts are joined via connections 48 and 49 to a source of cooling water.

Point controls 50 and 51 are provided for synchronizing the longitudinal motion of the two strips 21 and 23. Marks can be provided on strips 21 and 23 which are detectable by controls 50 and 51, either optically or magnetically, for example, so that when the strips do not run at synchronous speeds, either one can be restrained and slowed down by operation of vacuum brakes 52 or the braking track of the cooling and braking plate 37 provided with vacuum openings 40, previously described, until the marks on the strips as detected by controls 50 and 51 indicate that strips 21 and 23 are again synchronized, i.e., running at the same speeds.

The construction of the forming station 2 which has been described herein provides advantageous and rapid formation of strip 21 in a remarkable fashion. The forming of strip 21 occurs by forming the grooves from the middle of the strip outwardly until all grooves are formed at which time strip 21 is ready to be joined to strip 23. The filling or dosing unit 44, the sealing rolls 25 and the cutting device 46 are all of known construction and are therefore not described in detail. Similarly, the necessary drive means for the forming rolls, sealing rolls and the cutting device in machine casing 1 are conventional and are not described in detail.

As material of the strips 21 and 23 the same materials as used for packaging different goods are suitable, for example paper, paper laminated with thermoplastics, thermoplastic foils or aluminium foils laminated with thermoplastics.

While one advantageous embodiment has been chosen to illustrate the invention, it will be understood by those skilled in the art that various changes and modifications can be made therein without departing from the scope of the invention as defined in the appendant claims.

What is claimed is:

1. An apparatus for manufacturing and filling packages including first and second strips of packaging materials;

a forming station including a frame having a side plate;

a forming plate having a plurality of longitudinal grooves in one surface thereof;

means for feeding and guiding the first one of said strips along said plate in the direction of said grooves and adjacent said grooved surface;

said means for feeding including a plurality of longitudinally spaced positively driven forming rolls adjacent said one surface with said first strip between said rolls and said surface, said side plate having means for rotatably supporting said rolls in cantilever;

means for driving said rolls;

said rolls having annular ridges shaped to mate with said grooves and to press said strip into said grooves;

the first one of said rolls at one end of said plate having a pair of ridges laterally spaced apart on opposite sides of the centerline of said first strip to form a pair of continuous depressions in said strip;

each successive downstream one of said rolls having additional pairs of ridges spaced further apart than the outermost ridges on the preceding roll to successively form additional continuous grooves in said strip, working from near the center of said strip toward the outer margins thereof;

means downstream of said rolls for depositing material to be packaged in the elongated depressions formed in said first strip;

means for feeding, guiding and joining said second strip to said first strip along the regions of said first strip between depressions formed therein; and means for transversely sealing the joined strips and for severing the strips at the transverse joined regions into packages.

2. An apparatus according to claim 1 wherein said forming plate includes heating element means for heating said plate and said first strip during forming of said depressions.

3. An apparatus according to claim 2 and further comprising a cooling and braking plate disposed between said forming plate and said means for depositing, said cooling and braking plate having a grooved surface, the grooves therein being aligned with the grooves of said forming plate.

4. An apparatus according to claim 1 and further comprising means for adjusting the relative spacing between said forming plate and said forming rolls, said means comprising a parallelogram linkage and a worm drive for changing the altitude of the parallelogram defined by said linkage perpendicular to said plate.

5. An apparatus according to claim 4 and further comprising a cooling and braking plate disposed between said forming plate and said means for depositing, said cooling and braking plate being adjustable with said forming plate.

* * * * *